US005437745A

United States Patent [19]

Frank et al.

[11] Patent Number: 5,437,745

[45] Date of Patent: Aug. 1, 1995

[54] HIGH COPPER ALLOY COMPOSITION FOR A THERMOCOUPLE EXTENSION CABLE

[75] Inventors: Douglas E. Frank, Hillsdale; Ted Wang, North Caldwell, both of N.J.

[73] Assignee: Thermo Electric Corporation, Saddle Brook, N.J.

[21] Appl. No.: 217,621

[22] Filed: Mar. 25, 1994

[51] Int. Cl.[6] ..... C22C 9/06

[52] U.S. Cl. ..... 148/435; 420/485

[58] Field of Search ..... 148/435; 420/485

[56] References Cited

U.S. PATENT DOCUMENTS

| | | | |
|---|---|---|---|
| 2,696,544 | 12/1954 | Poch | 420/485 |
| 3,017,269 | 1/1962 | Finch et al. | 420/485 |
| 3,337,371 | 8/1967 | Agafonov et al. | 420/485 |
| 3,607,242 | 9/1971 | Gottlieb et al. | 75/159 |
| 3,776,781 | 12/1973 | Starr et al. | 136/239 |
| 4,002,500 | 1/1977 | Wang | 136/241 |

FOREIGN PATENT DOCUMENTS

| | | | |
|---|---|---|---|
| 700650 | 12/1953 | United Kingdom | 420/485 |

*Primary Examiner*—Deborah Yee

*Attorney, Agent, or Firm*—Plevy & Associates

[57] ABSTRACT

An alloy composition used in the manufacture of extension cables, comprises by weight 25.00% to 35.00% of nickel, 0.10% to 1.00% of manganese, 0.10% to 1.75% of cobalt, less than 0.25% of iron, and the balance being of copper. A thermoelement, of a thermocouple extension cable, manufactured from this composition exhibits a resistivity of approximately 240 ohms per circular mil foot. Hence, the loop resistivity of the cable, where the other thermoelement is made from copper, is generally less than 310 ohms per circular mil foot and the calibration accuracy of the cable from 0° to 100° C. is within ±2.5° C.

15 Claims, 1 Drawing Sheet

HIGH COPPER ALLOY COMPOSITION FOR A THERMOCOUPLE EXTENSION CABLE

FIELD OF THE INVENTION

This invention relates generally to a thermocouple extension cable used in connecting a Type K or 20 Alloy/19 Alloy Thermocouple sensor to associated instrumentation and in particular, to a compensating extension cable comprising copper as the positive extension wire and a low nickel/high copper alloy as the negative extension wire which achieves the same accuracy limits as a standard Type K extension cable, but with significant material cost savings.

BACKGROUND OF THE INVENTION

An important parameter in many control systems is temperature. One of the most commonly employed mechanisms for dealing with the control of temperature is the thermocouple sensor. Thermocouple sensors are utilized to measure the temperature in high temperature environments such as those associated with autoclaves, furnaces, boilers, etc. Consequently, the prior art is replete with patents describing thermocouple devices of various configurations and constructions.

The Type K thermocouple sensor (Ni/10 Cr versus Ni/5 (Si, AI)) is presently employed in a wide array of temperature measurement and control applications. As stated earlier, the thermocouple sensor is coupled to the instrumentation by way of an extension cable. It is necessary that the thermal EMF of the extension cable is the same as the thermocouple sensor from 0° C. to the temperature of the transition where the extension cable is connected to the thermocouple sensor. It is desirable, from the standpoint of maintaining accuracy of measurement, for the thermocouple extension cable to exhibit the lowest possible loop resistance. Lowering the loop resistance of an extension cable allows the same instrument error limits with extended lengths of the extension cable. This is an advantage in applications where very long distances on the order of 100 feet or more exist between the thermocouple sensor and the instrumentation. For example, very long extension cables are employed between thermocouple sensors used in oil fields and the requisite instrumentation. These cables can be on the order of 100 feet or longer. Thus, in this application, a cable having lower loop resistance would greatly increase the accuracy of the temperature measurements.

Further, an extension wire that has a lower loop resistivity value allows the use of a smaller diameter wire for a given length of cable. Reducing the cable diameters also provides the benefit of enhanced cable flexibility.

Two standards setting forth the initial accuracy requirements for thermocouple sensor extension wire are maintained in the industry, one being the U.S. standard and the other being the international standard. The U.S. standard tolerance (established by ANSI, ISA, NIST, and others) for Type K extension wire (KX) is ±2.2° C. The IEC international standard tolerance for Type KX is ±2.5° C. In the U.S. standard, only type K thermocouple alloy is used as KX extension wire. The applicable temperature range for KX wire, both under the U.S. and the international standard is 0° to 200° C.

Most thermocouple extension cables are insulated with a low temperature material such as Poly Vinyl Chloride (PVC). The inventors herein have, therefore, recognized that PVC insulated KX cables provide an effective operating temperature well below 200° C. (The operating temperature of a PVC insulated KX cable is limited by the PVC insulation which has a maximum operating temperature 105° C. as established by Underwriters Laboratory [UL]). The consequences of all this is that the users are paying for unneeded accuracy above 105° C.

Hence, it becomes apparent from this disclosure that a switch to an extension cable manufactured from a metal costing less than KX, which meets the industry's initial accuracy requirements for thermocouple sensor extension cables up to 105° C., would result in a substantial cost savings to users of the cables. Moreover, if this metal also exhibits a lower loop resistivity and thus a lower loop resistance, this would allow the use of a smaller diameter wire to achieve additional material savings.

It is, therefore an object of the present invention to provide an alloy composition for use in the manufacture of thermocouple extension cables having a lower loop resistivity and lower material cost than presently available compositions used in the manufacture of KX extension cables for use up to 105° C.

SUMMARY OF THE INVENTION

An alloy composition used in the manufacture of the negative leg of an extension cable, comprises by weight 25.00% to 45.00% of nickel, 0.10% to 1.75% of cobalt, 0.10% to 1.00% of manganese, less than 0.50% of iron, and the balance being of copper. A thermoelement, of a thermocouple extension cable, manufactured from this composition exhibits a resistivity of generally less than 300 ohms per circular rail foot. Hence, the loop resistivity of the cable, where the other thermoelement is made from copper (with a resistivity of 10 ohms/circular mil foot), is generally less than 310 ohms per circular mil foot and the calibration accuracy of the cable over the range of 0° C. to 100° C. is within ±2.5° C. The preferred range of each of the elements in the alloy composition of the present invention includes 29.00 to 33.00% of nickel, 0.30 to 1.00% of cobalt, 0.10 to 0.70% of manganese, and less than 0.10% of iron.

In a preferred embodiment of the invention the alloy composition comprises by weight 30.00% of nickel, 69% of copper, 0.40% of manganese, 0.60% of cobalt. A thermoelement, of a thermocouple extension cable, manufactured from the preferred composition exhibits a resistivity of 240 ohms per circular mil foot. Hence, the loop resistivity of the cable, where the other thermoelement is made from copper, is 250 ohms per circular mil foot and the calibration accuracy of the cable 0° to 100° C. is within ±2.2° C.

DETAILED DESCRIPTION OF THE INVENTION

Figure 1:
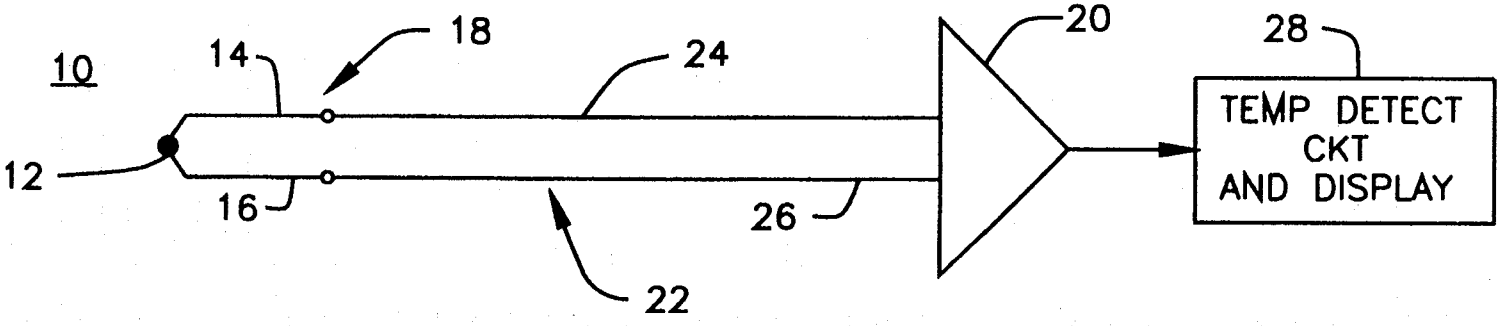
FIG. 1 illustrates a simple schematic circuit of an exemplary thermocouple arrangement employing thermocouple extension cables manufactured from the alloy composition of the present invention.

Referring now to FIG. 1 there is shown a simple schematic circuit of an exemplary thermocouple arrangement employing thermocouple extension cables manufactured from the alloy composition of the present invention used as an extension for a Type K thermocouple sensor. Thermocouple 10 comprises a positive thermoelement 14 and a negative thermoelement 16. A sensing junction 12 is formed at the junction of thermoelements 14 and 16. The opposite ends of the thermoelements 14 and 16 form the intermediate junction 18 of thermocouple 10. Thermoelements 14 and 16 are coupled to the input of a high impedance operational amplifier 20 via a thermocouple extension cable 22 comprising a copper thermoelement 24 and a thermoelement 26 manufactured from the alloy of the present invention. The copper thermoelement 24 is coupled between the positive thermoelement 14 and the first input of amplifier 20 and the alloy thermoelement 26 is coupled between the negative thermoelement 16 and the second input of the amplifier 20. The output of the amplifier 20 is coupled to the input of a temperature detection circuit and display. The two inputs of Amp 20 constitute the reference junction of the thermocouple assembly shown.

It is understood that the arrangement illustrates one of many applications one of ordinary skill in the art would recognize for extension cables made from the alloy composition of the present invention. Further, the alloy composition of the present invention is intended for the manufacture of thermocouple extension cables, however, the alloy composition of the present invention is capable of being used in other applications where gains would result from the resistivity and material cost characteristics of the present invention.

As previously stated, copper versus the alloy of the present invention meets Type KX international specification of +2.5° C. from 0° to 100° C. This cable composition presently enjoys a cost advantage when compared with KX as nickel is approximately four times more expensive than copper.

Furthermore, the inventors herein have recognized that the loop resistivity of an extension cable made from copper versus the present invention is generally half that of KX extension cable. As already mentioned, the accuracy of measurement with regard to the extension cable at the instrumentation is dependent on the loop resistance of the cable. As is well known, loop resistivity is defined as the combined resistivities of the positive and the negative thermoelements in ohms per circular mil foot. Further, the resistance of a conductor (in this case the thermoelements of the extension cable) can be expressed by the following equation:

$$R = p\, l/A$$

where R=resistance in ohms
l=length in feet
A=cross sectional area in square inches
p=resistivity in ohms per circular mil foot For example, the resistivity of copper at ambient temperature (20° C.)is 10 ohms per circular mil foot. Thus, a copper wire that is 1 foot in length and 0.001 inches in diameter will have a resistance at ambient temperature of 10 ohms. The resistivity of the conductor is dependent on its material characteristics, not its dimensions. The resistance can be obtained using the equation if p, land A are known.

Accordingly, it is proposed that a switch to copper versus the present invention from KX, would provide the same instrument error limit as KX with double the length of the extension cable because the loop resistivity of copper versus the present invention (310 ohms per circular mil foot) is generally half that of KX (600 ohms per circular mil foot). Consequently, using copper versus the present invention would allow a change to a smaller diameter wire to achieve material savings of approximately 50%.

In accordance with the present invention, the extension wire is formed from a metal alloy having a composition generally comprising copper (Cu), nickel (Ni), manganese (Mn), cobalt (Co), and a trace of iron (Fe). Since alloys are fundamentally an intentional mixture of two or more metals which are soluble in one another in the liquid state, alloying takes place by melting together the desired metals. As is well known, when the molten metals solidify, they remain soluble in one another or separate into intimate mechanical mixtures of the pure constituents metals.

Extension cables made from the alloy composition of the present invention are manufactured and processed according to methods that are well known in the art. Accordingly, an extension cable made from the alloy composition of the present invention can be made by induction melting the above-mentioned metals added in percentages which will be discussed in detail below, in a 800 pound or 3,000 pound furnace and pouring the melt into molds for 750 pound ingots. The ingots are hot rolled to rods, having a diameter of for example, 0.25 inches. The rods are then descaled and cleaned. After descaling and cleaning, the rods are drawn to various sizes, e.g. 16 gauge (0.051 inches in diameter), 20 gauge (0.032 inches in diameter) for solid conductor pairs or 34 gauge (0.0063) for stranded conductor pairs. After wire drawing and cleaning, the thermocouple extension wire is annealed and coated with an appropriate insulation. The wires are spooled into proper sized reels which are checked for calibration. The compositional ranges of the abovementioned elements are depicted below in Table 1.

TABLE 1

| ELEMENT | RANGE PERCENTAGE BY WEIGHT |
|---|---|
| Nickel | 25.00 to 45.00% |
| Copper | Balance |
| Cobalt | 0.10 to 1.75% |
| Manganese | 0.10 to 1.00% |
| Iron | less than 0.50% |

A thermoelement, of a thermocouple extension cable, manufactured from this composition where the amount of nickel is close to 45% exhibits a resistivity of generally less than 300 ohms per circular mil foot. Hence, the loop resistivity of the cable, where the other thermoelement is made from copper, is generally less than 310 ohms per circular mil foot, (10+300), and the calibration error of the cable from 0° to 100° C. is within ±2.5° C.

The preferred range percentages of the elements making up the composition of the present invention are listed below in Table 2.

TABLE 2

| ELEMENT | PREFERRED RANGE PERCENTAGE BY WEIGHT |
|---|---|
| Nickel | 29.00 to 33.00% |
| Copper | Balance |
| Cobalt | 0.30 to 1.00% |
| Manganese | 0.10 to 0.70% |
| Iron | LESS THAN 0.10% |

The loop resistivity of a cable manufactured from this composition, where the other thermoelement is made from copper, is essentially 250 ohms per circular mil foot, (10+240), and the calibration error of the cable from 0° to 100° C. is within ±2.2° C.

In a preferred embodiment of the invention the alloy composition comprises by weight 30.00% of nickel, 69% of copper, 0.40% of manganese, 0.60% of cobalt and essentially no iron. Extension cables were made from 4 duplicate trial melts, each of these melts being made according to the preferred composition. The extension cables drawn from these 4 melts displayed calibration errors at 100° C. of −0.7° C., −1.0° C., −0.4° C. and −0.8° C. which are well within the +2.2° C. U.S. standard and ±2.5° C. international standard. A thermoelement, manufactured from the preferred composition exhibited a resistivity of 240 ohms per circular mil foot. The loop resistivity of the cable, where the other thermoelement is made from copper, was 250 ohms per circular mil foot.

The resistivities of copper, the positive and negative thermoelements of KX (designated KP and KN) and the alloy of the present invention (where the amount of nickel is approximately 45%) and the preferred alloy composition of the present invention are set forth below along with the loop resistivity for extension cables made from the individual thermoelements for comparison in Table 3.

TABLE 3

| | RESISTIVITY OF THERMOELEMENT OHMS/CIR. MIL FT. | LOOP RESISTIVITY OF EXTENSION CABLE OHMS/CHT. MIL FT. |
|---|---|---|
| COPPER | 10 | |
| PREFERRED COMPOSITION | 240 | 250 |
| COMLPOSITION (≈45% NICKEL) | 300 | 310 |
| KP | 425 | |
| KN | 177 | |
| KX | | 602 |

Currently, the most popular cable sizes are 16 gauge and 20 gauge. From Table 3 it is clearly evident that the composition of the preferred embodiment allows a 20 gauge (0.032 inch diameter) cable made from the preferred composition to replace a 16 gauge (0.051 inch diameter) made from KX with the same instrument error because the loop resistivity of copper versus the alloy of the preferred composition is approximately half that of KX. Moreover, the loop resistivity of copper versus the preferred composition of the present invention is 20% lower than that of copper versus the composition of the present invention having approximately 45% nickel.

While the invention has been particularly shown and described with reference to specific exemplary embodiments of the alloy composition, other alloy compositions may become apparent to those skilled in the art that do not depart from the spirit and scope of the present invention. Hence, the present invention is deemed limited only by the appended claims and the reasonable interpretation thereof.

I/We claim:

1. An essentially binary alloy composition comprising a 25.00 to 33.00 weight percentage of nickel, a 0.10 to 1.00. weight percentage of manganese, a 0.10 to 1.75 weight percentage of cobalt the balance being copper, said composition providing a resistivity of approximately 240 ohms per circular mil foot.

2. The alloy composition according to claim 1, wherein said weight percentage of nickel is 29.00 to 33.00%.

3. The alloy composition according to claim 1, wherein said weight percentage of manganese is 0.10 to 0.70%.

4. The alloy composition according to claim 1, wherein said weight percentage of cobalt is 0.30 to 1.00%.

5. The alloy composition according to claim 1, further comprising a less than 0.25 weight percentage of iron.

6. The alloy composition according to claim 5, wherein said weight percentage of iron is less than 0.10%.

7. An essentially binary alloy composition used in manufacturing an extension cable consisting essentially of a 29.00 to 33.00 weight percentage of nickel, a 0.10 to 0.70 weight percentage of manganese, a 0.30 to 1.00 weight percentage of cobalt, a less than 0.10 weight percentage of iron the balance being copper, said composition providing a resistivity of approximately 240 ohms per circular mil foot when formed as the extension cable.

8. A thermocouple extension wire manufactured from an essentially binary alloy composition comprising a 25.00 to 33.00 weight percentage of nickel, a 0.10 to 1.00 weight percentage of manganese, a 0.10 to 1.75 weight percentage of cobalt the balance being copper, said thermocouple extension wire having a resistivity of approximately 240 ohms per circular mil foot.

9. The thermocouple extension wire according to claim 8, further comprising a weight percentage of iron that is less than 0.25%.

10. The alloy composition according to claim 8, wherein said thermocouple extension wire has a calibration accuracy from 0° to 100° C. of within ±2.2° C.

11. The alloy composition according to claim 9, wherein said thermocouple extension wire has a calibration accuracy from 0° to 100° C. of within ±2.5° C.

12. The alloy composition according to claim 1, wherein said alloy composition provides a calibration accuracy from 0° to 100° C. of within ±2.5° C. when said alloy composition is employed as a thermocouple extension wire.

13. The alloy composition according to claim 32 wherein said alloy composition provides a calibration accuracy from 0° to 100° C. of within ±2.2° C. when said alloy composition is employed as a thermocouple extension wire.

14. The alloy composition according to claim 7, wherein said alloy composition provides a calibration accuracy from 0° to 100° C. of within ±2.5° C. when said alloy composition is employed as said thermocouple extension cable.

15. The alloy composition according to claim 7, wherein said alloy composition provides a calibration accuracy from 0° to 100° C. of within ±2.2° C. when said alloy composition is employed as said thermocouple extension cable.

* * * * *

UNITED STATES PATENT AND TRADEMARK OFFICE

CERTIFICATE OF CORRECTION

PATENT NO. : 5,437,745

DATED : August 1, 1995

INVENTOR(S) : Douglas E. Frank & Ted Wang

It is certified that error appears in the above-identified patent and that said Letters Patent is hereby corrected as shown below:

Column 6, line 54- In claim 13, first line after "claim" delete "32" and insert --2--.

Signed and Sealed this

Tenth Day of October, 1995

Bruce Lehman

*Attest:*

BRUCE LEHMAN

*Attesting Officer*

*Commissioner of Patents and Trademarks*